United States Patent [19]

Corbet et al.

[11] Patent Number: 4,735,433

[45] Date of Patent: Apr. 5, 1988

[54] BINDING FOR CROSS-COUNTRY SKIS

[75] Inventors: Pierre Corbet, Grenoble; Serge Soulhiard, Sassenage; Roger Abondance, La Murette-Rives, all of France

[73] Assignee: Skis Rossignol S. A., Voiron, France

[21] Appl. No.: 935,765

[22] Filed: Nov. 28, 1986

[30] Foreign Application Priority Data

Dec. 5, 1985 [FR] France ..... 85 18723
Jun. 30, 1986 [FR] France ..... 86 10119

[51] Int. Cl.[4] ..... A63C 9/20

[52] U.S. Cl. ..... 280/615; 280/628; 280/632

[58] Field of Search ..... 280/609, 614, 615, 628, 280/631, 632

[56] References Cited

U.S. PATENT DOCUMENTS 4,410,199 10/1983 Eisenberg ..... 280/615
4,487,427 12/1984 Salomon ..... 280/636

FOREIGN PATENT DOCUMENTS 76857 7/1918 Austria ..... 280/618
53894 4/1934 Norway ..... 280/635

*Primary Examiner*—John J. Love
*Assistant Examiner*—Richard Camby
*Attorney, Agent, or Firm*—Karl F. Ross; Herbert Dubno; Ronald Lianides

[57] ABSTRACT

A projecting nose from the grooved body is engaged in a stirrup to retain the boot on the ridge of a cross-country ski to which the stirrup is pivotally connected by an axis transverse to the ridge. An outer stirrup can be swung relative to the inner stirrup to cause a rod to rise in arcuate windows of the inner stirrup and thereby lift the nose of the boot and clamp it against the fixed cross-piece of the inner stirrup. A detent plate pivotal on an outer stirrup can releasably latch the outer stirrup relative to the inner stirrup.

20 Claims, 2 Drawing Sheets

BINDING FOR CROSS-COUNTRY SKIS

CROSS-REFERENCE TO RELATED APPLICATION

This application is related to the commonly owned copending application Ser. No. 738,552 filed May 28, 1985 by two of the present joint inventors together with others.

FIELD OF THE INVENTION

Our present invention relates to a ski binding for affixing a boot to a cross-country ski and, more particularly, to a device or assembly whereby a boot of a cross-country skier can be pivotally fixed to a cross-country ski of the type wherein, at least in a zone directly below the foot of the skier, a ridge of generally trapezoidal cross section is provided to cooperate with a complementary groove in the ski boot and the ridge is delimited by an upper surface and by two lateral faces or flanks which are oblique and diverge downwardly away from the upper surface to respective ledges at the bottom of the ridge to which vertical flanks along the longitudinal edges of the ski rise, e.g. as described in the aforementioned application.

BACKGROUND OF THE INVENTION

As has been indicated in the foregoing copending application and as will also be apparent from Europatent document EP-A-No. 0 167 462, cross-country skis with ridges of the aforedescribed type of generally trapezoidal cross section are increasingly in common use and, of course, devices have been developed to connect the ski boot, which can have a groove complementary to the ridge to the boot of the ski.

The pivotal connection between the ski boot and the ski body can provide a pivot axis for the toe clamp of the ski constituting the binding or for the boot itself which extends directly through the ridge below the upper surface thereof and transversely of the ridge.

In the Europatent document, commonly owned with the present application, there is described a device for affixing the ski boot to the ski which comprises a stirrup mounted on the ski and having two arms which are disposed on opposite sides of the longitudinal ridge of the ski and connected by a crosspiece located above the ridge.

The two arms are swingable on the ski about a transverse axis traversing the ridge and the part of the stirrup which lies above the ridge has a shape enabling it to engage a projection or nose formed at the toe of the ski body. Means can be provided for clamping this nose to the stirrup.

The clamping or locking means which thus serves to immobilize the front of the boot to the pivotal stirrup in this system is constituted by a lever articulated on the stirrup by an intermediate element so that it swings about an axis parallel to the pivot axis of the lever and can enable the latter to come to bear on the projection at the front of the boot.

While the principle of this system may be valid, in practice the device is not as easy to use as is desired and hence improvement in the toe binding structure has been indicated.

OBJECTS OF THE INVENTION

It is, therefore, the principal object of the invention to provide a binding for a ski boot and cross-country ski of the type described which is easier to use and is of a more practical construction than the earlier binding described above.

Another object of this invention is to provide a simple, easily fabricated and easily used toe clamp for a cross-country ski boot of a cross-country ski having the groove and ridge constructions previously described and which represents an advance in devices of this kind.

SUMMARY OF THE INVENTION

These objects and others which will become apparent hereinafter are attained, in accordance with the invention in a toe clamp or binding for a cross-country ski of the type described, i.e. having the aforementioned ridge with inclined flanks stepped inwardly of a bottom portion of the ski of lesser height but defined between parallel flanks and for a boot having a longitudinal groove which is complementary to and adapted to rest upon the longitudinal ridge of the ski.

According to the invention, the stirrup which has its arms pivotal on the ski about an axis below the upper surface of the ridge and traversing the latter, is equipped with two complementary means, a first arranged after engagement with the projecting nose of the boot to lift this nose so that it is effectively retained in the stirrup, e.g. by bringing it into engagement with the underside of the crosspiece. The other means is provided to fix the nose of the boot and the stirrup in their engaged position as brought about by the lifting means. More particularly, the invention comprises a ski binding for affixing a boot to a cross-country ski having a ridge along an upper surface of the ski defined between a pair of downwardly diverging inclined flanks, the boot having a nose at a toe-end thereof and a groove complementary to the ridge and adapted to receive the ridge when the boot rests on the upper surface of the ski, the binding comprising:

- a stirrup having a crosspiece extending transversely across the ridge and arms extending downwardly along the flanks;
- means pivotally connecting the arms to the ridge to enable the stirrup to swing about a pivot axis traversing the ridge and transverse thereto, the stirrup receiving the nose between the arms and below the traverse;
- a member movably mounted on the stirrup below the nose and actuatable to lift the nose and clamp the nose against the crosspiece;
- an actuator on the stirrup operatively connected with the member for lifting same upon movement of the actuator relative to the stirrup from one position to another position; and
- means on the stirrup for releasably latching the actuator in the other position.

Advantageously, the actuator is a lever swingable mounted on the stirrup about a fulcrum axis, the member being fixed to the lever eccentric to the fulcrum axis and being displaceable by the lever along an arc of a circle centered on the fulcrum axis.

In the preferred embodiment of the invention, the lever is formed by an outer stirrup having arms straddling the arms of the first-mentioned stirrup which is constituted as an inner stirrup and pivotally connected thereto for swinging movement about the fulcrum axis, the member being a rod bridging the arms of the outer stirrup and traversing respective arcuate slots formed in the arms of the inner stirrup, the nose of the ski boot being clamped between the rod and the crosspiece in the other position of the outer stirrup.

The outer stirrup is thus articulated on the inner stirrup and has a bar or rod as described which is located eccentrically to its pivot axis on the inner stirrup but passing through at least one but preferably both arms of the inner stirrup and thus through at least one but preferably two arcuate windows or slots formed in the inner stirrup, the arcuate window or windows being concentric to the pivot axis of the outer stirrup on the inner stirrup.

This rod or bar can therefore engage in a downwardly open groove in the nose and lift the nose toward the crosspiece of the inner stirrup so that a tongue at the upper part of the nose can engage in a groove on the underside of this crosspiece.

The front end or nose of the boot, therefore, is clamped between this movable transverse member or rod of the outer stirrup and the crosspiece which is fixed on the inner stirrup.

The means for releasably latching the outer stirrup in its locking position relative to the inner stirrup being provided to maintain the engagement of the front end of the boot until the latter means is released.

Preferably the movable traverse or rod is mounted elastically on the outer stirrup, e.g. by resilient plugs or sleeves.

According to another preferred feature of the invention, the arms of the inner stirrup have bases which extend toward the ski boot and are connected by another crosspiece which is shaped to hug the ridge and can underlie the toe of the ski boot and fit into the groove thereof so that, when the ski boot is pressed down at its toe, it likewise holds down this other crosspiece.

The releasable latching means can advantageously include a plate whose tongue can engage in a detent recess on the upper side of the crosspiece of the inner stirrup and which can be biased by an elastic body into engagement with this recess.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
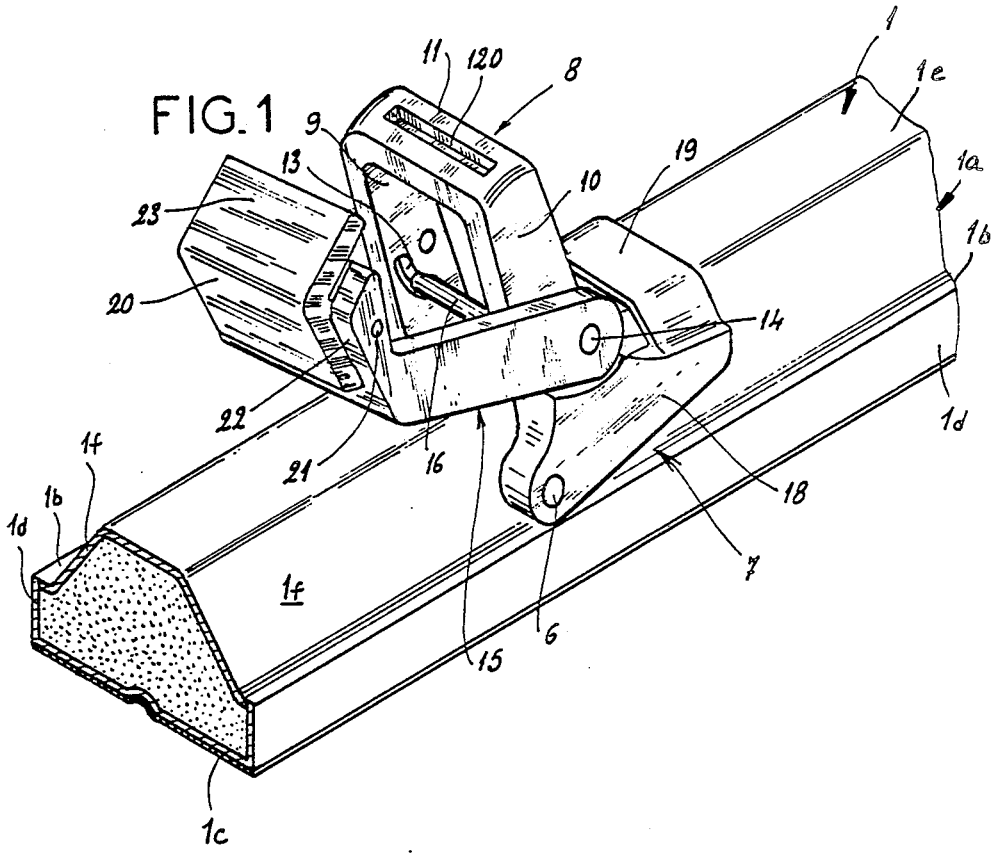
FIG. 1 is a fragmentary perspective view of the binding of the invention on a cross-country ski.

The cross-country ski shown at 1 in the drawing, comprises a ridge 1*a* which, at its bottom, terminates in a step 1*b* on each side of the ski and, of a height greater than the height of the step above the running surface or bottom 1*c* of the ski. The ski boot thus has a pair of parallel flanks 1*d* of relatively small height, an upper surface 1*e* which is parallel to the bottom 1*c*, and a pair of oblique flanks 1*f* which diverge downwardly from the upper surface 1*e*. The ridge 1*a* can be provided preferably over the entire length of the ski but at least is provided in the region underlying the ski boot which has been shown at 2 in dot-dash lines in FIGS. 2 and 3. The ski boot has a groove represented at 2*a* which is complementary to the longitudinal ridge 1*a* and is adapted to rest thereon (FIG. 3).

The ridge and groove construction can be similar to that shown in the aforementioned copending application.

The binding or toe clamp for the ski boot has been represented generally at 7 and is pivotally connected to the ski 1 by a pintle 6 defining the pivot axis which traverses the ridge below the upper surface thereof.

The toe clamp or binding 7 comprises a stirrup 8 of inverted U shape with two lateral arms 9 and 10 and a transverse member 11 which can be denominated a crosspiece or traverse positioned so that this stirrup can receive below the crosspiece 11 a complementary part of the boot 2 to be engaged therein, namely, a projection or nose 3 formed at the toe end of the boot and adapted to fit freely under the crosspiece 11.

The crosspiece 11 is formed over a major part of its length on its upper surface with a groove 120 transverse to the ridge and constituting a detent recess as will be described.

On its underside, the traverse 11 is formed with a lower groove 121 likewise transverse to the ridge and adapted to receive a complementary rib or tongue 4 of the nose 3.

Each of the lateral arms 9 and 10 is provided with an arcuate window or slot 13 conforming to the arc of a circle centered on a pivot serving as the fulcrum axis of a lever in the form of an outer stirrup 15, likewise having the configuration of an inverted U and having its arms straddling the lateral arms 9 and 10 of the inner stirrup 8.

A bar, rod or like movable traverse 16 is carried by the arms of the outer stirrup 15 and passes through the windows 13 so that this rod is movable in an arcuate path centered on the fulcrum axis of the outer stirrup 15. The connection between the rod 16 and the outer stirrup 15 is effected by the intermediary of two elastic plugs or sleeves 27.

The fulcrum axis of the outer stirrup 15 on the inner stirrup is shown at 14 and can be defined by respective pivot pins.

Figure 2:
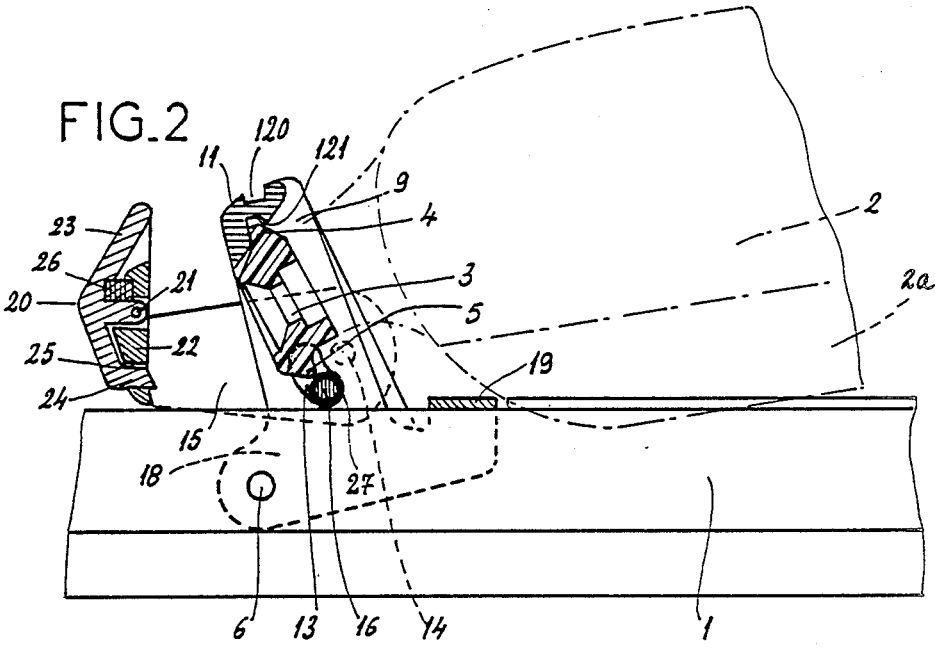
FIG. 2 is a side elevational view, partly in longitudinal section, showing the relationship between the ski and binding when the toe of the boot is introduced into the binding and before the latch has been engaged.
Figure 3:
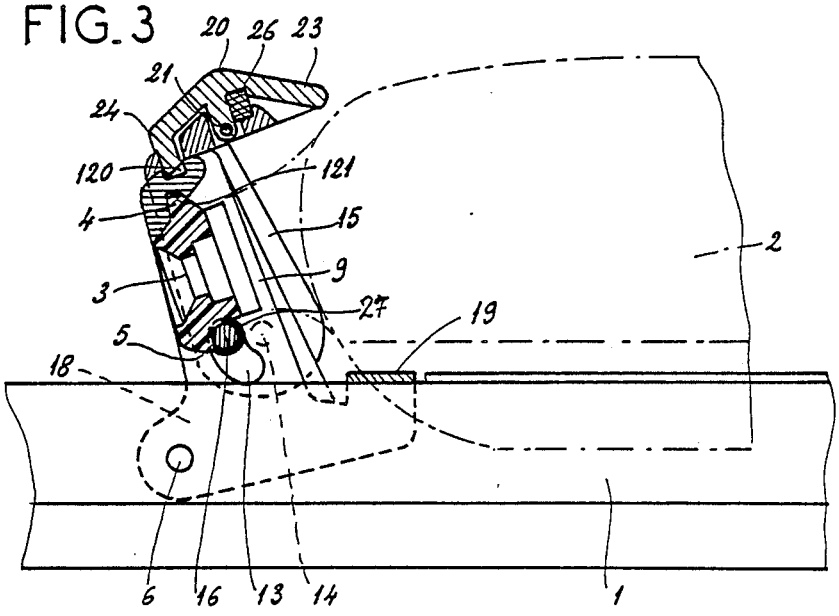
FIG. 3 is a view corresponding to FIG. 2 but showing the positions of the elements after the latch has been engaged.

In the position shown in FIG. 2, the outer stirrup 15 is in its lowermost position (see also FIG. 1) and thus the rod 15 forming the movable traverse likewise lies in its lowermost position in the slots 13. The clearance between the rod 16 and the crosspiece 11 is sufficient to allow insertion of the nose 3 to the left as indicated in FIG. 2.

The outer stirrup is then swung in the clockwise sense relative to the inner stirrup (FIGS. 2 and 3), i.e. toward the boot 2, to lift the rod 1 and thereby lift the nose 3 of the boot into engagement with the crosspiece 11. During this operation, the elastic sleeve 27 is compressed.

A ridge 5 along the underside of the nose 3 delimits a groove into which the rod 16 fits to retain the nose against retraction to the right.

A lever plate 20 is articulated to the outer stirrup 15 about an axis 21 which likewise is transverse to the ridge 1*a*. This lever is mounted on the upper crosspiece 22 of the outer stirrup 15.

This plate has an actuating arm 23 and a tongue 24, the latter engaging through a window 25 of the crosspiece 22 and being adapted to spring into the groove 120 previously mentioned.

The detent plate 20 is biased in the counterclockwise sense about the pivot 21 as illustrated in FIGS. 2 and 3 by an elastic body or plug 26 which can be composed of rubber. Other resilient biasing means can, of course, also be used.

To release the boot, all that is required is to trip the arm 23 of the plate lever 20 and to swing the outer stirrup 15 in the counterclockwise sense about its pivot 14, thereby lowering the rod 16 and retracting it from the nose 3.

The two bases 18 of the arms 9 and 10 of the inner stirrup, traversed by the pintle 6 forming the pivot axis of the inner stirrup and the toe clamp, are connected by a further crosspiece 19 offset with respect to the arms and the pivots, in the direction of the boot 2. The crosspiece 19 can be of small thickness and has generally the shape of the ridge along which it is intended to lie in close-fitting relationship so that it can also fit within the groove of the boot 2 (see FIG. 3) without causing it to lift undesirably.

The additional crosspiece 19 makes the stirrup 8 more rigid and the vault configuration which results because of the conformity of this crosspiece to the ridge, ensures effective integration of the boot and the toe clamp for pivotal movement relative to the ski and for flat engagement of the boot with the ski.

FIG. 2 shows the position for engagement of the boot in the clamp, the nose 3 being inserted from the right until it lies to the left or forwardly of the rod 16. The outer stirrup 15 is then raised in the manner described and latched in place.

During the ascending circular movement of the rod 16, it not only comes to lie behind the rib 5 thereof, but also to lift the rib 4 into engagement with the groove 121 on the underside of the crosspiece 11.

Release of the latch can be effected by tripping the arm 23, e.g. using a ski pole.

We claim:

1. A ski binding for affixing a boot to a cross-country ski having a ridge along an upper surface of the ski defined between a pair of downwardly diverging inclined flanks, said boot having a nose at a toe-end thereof and a groove complementary to said ridge and adapted to receive said ridge when said boot rests on said upper surface of said ski, said binding comprising:

a stirrup having a crosspiece extending transversely across said ridge and arms extending downwardly along said flanks;

means pivotally connecting said arms to said ridge to enable said stirrup to swing about a pivot axis traversing said ridge and transverse thereto, said stirrup receiving said nose between said arms and below a transverse pivot axis through said flanks below said upper surface of said ridge;

a member movably mounted on said stirrup below said nose and actuatable to lift said nose and clamp said nose against said crosspiece;

an actuator on said stirrup operatively connected with said member for lifting same upon movement of said actuator relative to said stirrup from one position to another position; and means on said stirrup for releasably latching said actuator in said other position.

2. The binding defined in claim 1 wherein said actuator is a lever swingable mounted on said stirrup about a fulcrum axis, said member being fixed to said lever eccentric to said fulcrum axis and being displaceable by said lever along an arc of a circle centered on said fulcrum axis.

3. The binding defined in claim 2 wherein said lever is formed by an outer stirrup having arms straddling the arms of the first-mentioned stirrup which is constituted as an inner stirrup and pivotally connected thereto for swinging movement about said fulcrum axis, said member being a rod bridging the arms of said outer stirrup and traversing respective arcuate slots formed in the arms of said inner stirrup, the nose of said ski boot being clamped between said rod and said crosspiece in said other position of said outer stirrup.

4. The binding defined in claim 3, further comprising means for elastically mounting said rod on the arms of the outer stirrup.

5. The binding defined in claim 4 wherein the means for elastically mounting said rod on the arms of the outer stirrup includes elastic sleeves surrounding said rod at opposite ends thereof.

6. The binding defined in claim 3 wherein each of the arms of said inner stirrup is formed with a base extending toward said boot, said bases being interconnected by another crosspiece transverse to said ridge and spaced from said pivot axis toward said boot, said other crosspiece having a contour complementary to that of said ridge so that said other crosspiece can lie snugly thereupon when held downwardly by the walls of the groove of the boot.

7. The binding defined in claim 3 wherein said means on said inner stirrup for releasably latching said actuator in said other position includes a detent plate on said outer stirrup engageable in a recess on said crosspiece of said inner stirrup, and resilient means biasing said detent plate into engagement with said recess.

8. The binding defined in claim 7 wherein said nose is formed with an upward projection engageable in a downwardly open groove on an underside of said crosspiece.

9. The binding defined in claim 8 wherein said nose is formed with a downwardly open groove receiving said rod.

10. The binding defined in claim 9 wherein said plate is pivotally mounted on said outer stirrup and has one side formed with a tongue engageable in said recess on said crosspiece and another side turned toward said boot and actuatable to release said tongue from said recess and enable disengagement of said nose from said inner stirrup.

11. A cross country ski assembly, comprising:

a cross-country ski constituted of a ski body formed with:

a bottom surface engageable with snow, and a ridge unitary with said body and extending over at least a portion of the length of said ski and defining the top of the ski, said ridge being formed with an upper surface substantially parallel to said bottom surface, and a pair of oblique flanks diverging downwardly from said upper surface;

a boot adapted to receive the foot of a skier and formed with a longitudinal groove complementary in shape to that of the ridge and adapted to rest upon said ridge, said boot having a nose at a toe-end thereof; and a ski binding for affixing said boot to said cross-country ski, said binding comprising:

a stirrup having a crosspiece extending transversely across said ridge and arms extending downwardly along said flanks, means pivotally connecting said arms to said ridge to enable said stirrup to swing about a pivot axis traversing said ridge and transverse thereto below said upper surface, said stirrup receiving said nose between said arms and below said crosspiece, a member movably mounted on said stirrup below said nose and actuatable to lift said nose and clamp said nose against said crosspiece, an actuator on said stirrup operatively connected with said member for lifting same upon movement of said actuator relative to said stirrup from one position to another position, and means on said stirrup for releasably latching said actuator in said other position.

12. The assembly defined in claim 11 wherein said actuator is a lever swingable mounted on said stirrup about a fulcrum axis, said member being fixed to said lever eccentric to said fulcrum axis and being displaceable by said lever along an arc of a circle centered on said fulcrum axis.

13. The assembly defined in claim 12 wherein said lever is formed by an outer stirrup having arms straddling the arms of the first-mentioned stirrup which is constituted as an inner stirrup and pivotally connected thereto for swinging movement about said fulcrum axis, said member being a rod bridging the arms of said outer stirrup and traversing respective arcuate slots formed in the arms of said inner stirrup, the nose of said ski boot being clamped between said rod and said crosspiece in said other position of said outer stirrup.

14. The assembly defined in claim 13, further comprising means for elastically mounting said rod on the arms of the outer stirrup.

15. The assembly defined in claim 14 wherein the means for elastically mounting said rod on the arms of the outer stirrup includes elastic sleeves surrounding said rod at opposite ends thereof.

16. The assembly defined in claim 13 wherein each of the arms of said inner stirrup is formed with a base extending toward said boot, said bases being interconnected by another crosspiece transverse to said ridge and spaced from said pivot axis toward said boot, said other crosspiece having a contour complementary to that of said ridge so that said other crosspiece can lie snugly thereupon when held downwardly by the walls of the groove of the boot.

17. The assembly defined in claim 13 wherein said means on said inner stirrup for releasably latching said actuator in said other position includes a detent plate on said outer stirrup engageable in a recess on said crosspiece of said inner stirrup, and resilient means biasing said detent plate into engagement with said recess.

18. The assembly defined in claim 17 wherein said nose is formed with an upward projection engageable in a downwardly open groove on an underside of said crosspiece.

19. The assembly defined in claim 18 wherein said nose is formed with a downwardly open groove receiving said rod.

20. The assembly defined in claim 19 wherein said plate is pivotally mounted on said outer stirrup and has one side formed with a tongue engageable in said recess on said crosspiece and another side turned toward said boot and actuatable to release said tongue from said recess and enable disengagement of said nose from said inner stirrup.

* * * * *